US005437955A

United States Patent [19]

Michlin

[11] Patent Number: 5,437,955

[45] Date of Patent: Aug. 1, 1995

[54] DRY TYPE TONER IMPROVEMENT WITH LUBRICANT

[76] Inventor: Steven B. Michlin, 5310 Bentley Suite 105, West Bloomfield, Mich. 48322

[21] Appl. No.: 253,410

[22] Filed: Jun. 3, 1994

Related U.S. Application Data

[63] Continuation-in-part of Ser. No. 236,374, May 2, 1994, which is a continuation-in-part of Ser. No. 914,530, Jul. 17, 1992, Pat. No. 5,308,515.

[51] Int. Cl.[6] ..... G03G 5/08

[52] U.S. Cl. ..... 430/110; 430/106

[58] Field of Search ..... 430/110, 106

[56] References Cited

U.S. PATENT DOCUMENTS

| | | | |
|---|---|---|---|
| 3,053,688 | 9/1962 | Greig | 430/110 |
| 3,577,345 | 5/1971 | Jacknow et al. | 430/109 |
| 3,590,000 | 6/1971 | Palermiti et al. | 430/110 |
| 4,218,530 | 8/1980 | Lu | 430/110 |
| 4,404,270 | 9/1983 | Higashida et al. | 430/110 |
| 4,585,723 | 4/1986 | Kishi et al. | 430/110 |
| 4,960,665 | 10/1990 | Elder et al. | 430/110 |
| 4,985,328 | 1/1991 | Kumagai et al. | 430/110 |
| 5,294,490 | 3/1994 | Sasaki et al. | 430/110 |

OTHER PUBLICATIONS

*Glossary of Mineral Species,* Michael Fleischer, The Mineralogical Record, Tucson, Ariz., p. 219 (1987).

*Manual of Mineralogy,* Klein and Hurlbut, Jr., John Wiley & Sons, N.Y., pp. 427–429 (1985).

*Chemical Abstracts* 93:246118e. (1980).

*Primary Examiner*—Christpher D. Rodee

[57] ABSTRACT

A dry toner composition for electrophotography includes a binder resin, a coloring agent and a mica-group mineral. The mica-group mineral provides the toner composition with lubricity and better flow capabilities. The mica-group mineral is wet-ground and may be coated with calcium stearate to reduce static electricity generated during operation of the printer, copier, or facsimile machine. The mica-group mineral and calcium stearate blend comprises ninety percent by weight or more of the mica-group mineral and ten percent by weight or less of the calcium stearate. The mica-group mineral or the mica-group mineral coated with calcium stearate makes up about zero-point-one to around fifteen percent by weight of the toner composition. The lubricant and flow agent formed by the mica-group mineral with or without the calcium stearate may be mixed into conventional dry toner as a post-additive. A mica-group mineral would be wet-ground to a very small particle size -for use in toners requiring smaller particle size and lower melting points for high speed printing operations.

6 Claims, No Drawings

DRY TYPE TONER IMPROVEMENT WITH LUBRICANT

This application is a continuation-in-part of application Ser. No. 08/236,374, filed May 2, 1994, which in turn was a continuation-in-part of applicant's Ser. No. 914,530, filed July 17, 1992, now U.S. Pat. No. 5,308,515, granted May 3, 1994.

BACKGROUND OF THE INVENTION

This invention relates to an improved dry toner formulation as used in Xerography and originally developed for the toner cartridge remanufacturing industry. This includes copiers, laser printers, facsimile machines and microfiche printers.

CANON has designed an all-in-one cartridge as seen in Pat. No. 4,975,744, issued Dec. 4, 1990 and assigned to CANON. Several companies have used these cartridges in laser printers, copy machines and facsimile machines, each with the varying printer engines and a different nameplate. Originally, these cartridges were designed to be "disposable". However, after the first all-in-one toner cartridge was introduced, it did not take long before laser cartridge remanufacturers such as myself began remanufacturing these cartridges. These "disposable" cartridges were designed to function for only one cartridge cycle without remanufacturing. The remanufacturers has found certain components that needed replacement on a regular basis. In 1990, the first aftermarket photoreceptor drum became available for use in remanufacturing the all-in-one cartridge of the "SX" engine variety, the most popular printer cartridge from around 1987 through 1994. When the long-life photoreceptor drum became available, the entire remanufacturing industry turned around and gained great strength and began a huge growth surge that still continues. In October 1993, HEWLETT-PACKARD, the largest seller of this printer engine using the all-in-one cartridge, entered the cartridge remanufacturing industry with the "Optiva" cartridge, further increasing the size as well as credibility of this relatively new industry. However, this relatively new industry grew from the all-in-one cartridge shortly after its debut. Before the introduction of the long-life drum, sometimes called the "superdrum" or "duradrum", the SX cartridge would last for around three cartridge remanufacturing cycles at best, since the actual useful life of the OEM drum was three cycles. However, the long-life drums got their names from the fact that they were designed to last for many remanufacturing cycles or recharges as they are sometimes called. Typically, the long life drum can last for ten or more such cycles, unlike the typical OEM (Original Equipment Manufacturer) drum. With the additional developments of drum coatings, originally designed for OEM drums, the long-life drum may last for many additional cycles. Some coatings, in theory, were designed to be dissolved and removed from over the drum surface every 1–3 cycles, so the drum life of the long-life drum almost seems limitless.

However, with photoreceptor drums lasting for many cycles, other components of the cartridge have a tendency to require greater durability, a better solution, or a greater life. Also, as the success of these cartridges has skyrocketed, the demand is for cartridges with longer cycles, so component improvements are significant. Therefore, avoiding natural problems with prevention means must also be implemented for cartridges of longer life both in longer cycle times and greater number of cycles. Dry toner powder is no exception. Many problems occur that cause premature failure. One example is ghosting (double imaging) caused by poor wiping of the photoreceptor drum with the wiper blade due to toner formulations in need of improvement. Another is ghosting caused at the (heat roller) fuser roller section because the fuser section no longer uses a fuser cleaner pad that oils it to prevent toner stick in the HP LX, NX, and EX printers. The OEM toner has components in the toner to help that the prior art aftermarket toners do not use to prevent toner stick to the heat fuser roller, usually TEFLON coated. One of the reasons for this problem is that toners with a relatively low melting point are required to function in a continuous high-speed application. Traditionally, this problem has been prevented by using a fuser roller cleaner wand with a felt pad that continuously cleans and oils the hot fuser roller as it turns. However, the practice of designing printers with self-oiling fuser cleaner pads has been abandoned by many OEM manufacturers. It is now expected that toners will function flawlessly without the self-oiling fuser roller cleaner pads.

Typically, there are different toner types. There are monocomponent type dry toners where the toner and developer are mixed together. Other compositions use multicomponent toners where the toner and developer are each separate powders. Many multicomponent toners also use carriers to help move the toner. The lubricant/flow agent of this invention may be applied to all toner, developer and toner-developer combinations, all kinds of dry toners.

Another problem is in the LX, BX and some other toner cartridges and the FX facsimile toner cartridge. When sealed with the aftermarket seals of which this applicant has three patents, (for example, U.S. Pat. No. 5,296,902, granted Mar. 22, 1994) the toner is driven horizontally with a paddle in the toner hopper through a narrow slot or passageway to the feed roller compartment. When the toner moves through this passageway, it may fill a portion of this narrow constriction and cause toner blockage resulting in a white streak on the output page before the toner cartridge is out of toner. In the past, some endusers have had success with the seal only later to find a toner blockage after using a different batch of toner with poor flow properties. Consequently, because of the described problems and similar problems experienced with applicant's patented shipping seals, applicant has developed a toner and a toner additive to solve the problem.

Other lubricants and flow agents have been used in the prior art. For example, zinc stearate has been used for years. Ground KYNAR powder has been used for quite some time. Among other finely ground powdered components used for this purpose in prior art are carnauba wax, colloidal silica and aluminum oxide.

In U.S. Pat. No. 4,395,485, Kashiwagi et al combine dry toner with a hydrophobic flow agent to maintain the flow of the toner in humid conditions. This agent would not lubricate the toner cartridge components.

Kurematsu et al, in their U.S. Pat. No. 4,748,474, suggest using TEFLON or similar lubricants in not less than 0.5 percent by weight with respect to the toner. U.S. Pat. No. 5,079,123 to Nanya et al discloses a dry-type toner which includes carnauba wax, substantially free of aliphatic acids, as a lubricant. The Background of the Nanya et al invention lists Japanese patents which add to dry toner such lubricants or releasants as silicone, varnish, fatty acids, higher alcohol, and other waxes.

U.S. Pat. No. 5,211,864 to Godlove is of interest for showing a slurry used to lubricate the cleaning blade in a printing machine. The slurry is a combination of a toner and a wax component and is applied to the blade prior to assembly and machine start-up. An electrophotographic toner composition disclosed by Kawasaki et al in U.S. Pat. No. 5,230,978 was developed for high speed and lower-heat copying machines. The composition uses various low-melt-viscosity and high-strength resins but, as best understood, does not contain a lubricant.

SUMMARY OF THE INVENTION

Accordingly, it is an object of this invention to provide a dry toner composition which includes a lubricant and flow agent for enhanced performance.

A further object of this invention is to provide a post-additive which, when mixed with conventional dry toner by the enduser, improves the lubricity and flow capabilities of the dry toner.

Another object of this invention is to increase the resolution and sharpness of the image produced in high speed operation of imaging machines.

In carrying out this invention in the illustrated embodiments thereof, a lubricant and flow agent comprised of a mica-group mineral (preferably wet-ground) or a mica-group mineral coated with calcium stearate is mixed with a binder resin and a coloring agent to form a dry toner. The improved dry toner, as it is used in the imaging process, lubricates the toner cartridge components (such as the wiper blade), flows without clogging passages and fouling components within the cartridge, and doesn't stick to the fuser roller. The lubricant and flow agent of this invention may be used as a post-additive to conventional dry toner, making it more versatile than prior art lubricants. It is added to the toner in a proportion ranging from 0.1 to around 15 percent by weight of the dry toner.

The toner lubricant and flow agent of this invention is generally less expensive than other types of lubricants used in toner cartridges. It is not hazardous like commonly used zinc stearate. The mica-group mineral additive with or without the calcium stearate coating is superior in performance as compared to toner additives of the prior art such as carnuba wax. The toner lubricant and flow agent of this invention does not require high purity and lessens the number of components or agents needed to interact within the dry toner. The mica-group mineral may be wet-ground to smaller particle sizes for use with toner in low melting point, high speed printing operations, preserving the quality of the images produced.

COMPLETE DESCRIPTION OF THE PREFERRED EMBODIMENT

This invention mixes a mica-group mineral with dry toner to provide a unique toner which flows from the toner hopper of a toner cartridge without clogging passages and seals and also has lubricating properties.

Mica has a high dielectric constant, making it a good insulator of electricity and heat. In fact, it is generally impervious to heat. Mica's excellent lubrication properties come forth through a wet-grinding process. Mica molecules are connected in a layered, large plate or sheet-like structure, somewhat like the pages of a book. In the wet-grinding process, a large mill roll passes over a bed of wet mica. The weight and friction of the mill roll de-laminates the molecular structure. In other words, when mined mica is wet-ground, the large plates of its structure are broken up into thinner, shorter plates, and good particle alignment is maintained. A typical median particle size of wet-ground mica for the purpose of this invention has been found to be 39±4 microns or less. Twelve micron and smaller also works well. This gives very good, cold, dry lubricity, very good particle resiliency, and excellent particle alignment. Eighty-eight percent of the material would pass through a 325 mesh screen, and the mica would not be hydroscopic except at high temperatures. In the lubrication function, the thin, short, aligned plates of the wet-ground mica would slide along each other easily. Dry-grinding the mica would break the plates into random pieces, making the mica much less effective as a lubricant.

Water-ground mica is clean, odorless and has high luster. The particles are smooth and regular. Unlike hazardous zinc stearate (a lubricant commonly used in toner cartridges), mica-group minerals are safe to use as dry lubricants.

It should be noted that small amounts of silicon dioxide ($SiO_2$, CAS No. 14808-60-7) are present in mica due to the mining process. But these small amounts do not affect the lubrication properties. It also would not be cost effective to remove the silicon dioxide sand from the mica mineral. For purposes of this application, the silicon dioxide is considered to be a part of the mica-group mineral.

The mica group of minerals have the general composition of $(SiAl)_4O_{10}(OH)_2$ with alkalis and magnesium. All are pseudohexagonal monoclinic, which allows stacking in a book-like structure and allows a wide range of compositions. Examples of mica-group minerals having this general composition and other mica-group minerals which may be used in this invention are listed below:

Anandite, annite, biotite, bityite, celadonite, chernykhite, clintonite, ephesite, glauconite, hendricksite, kinoshitalite, lepiodolite, margarite, masutomilite, montdorite, muscovite, paragonite, phlogopite, polylithionite, roscoelite, siderophyllite, taeniolite, wonesite, and zinnwaldite.

Any of these or other micas could be used as the toner additive or ingredient in this invention. Of these, muscovite (CAS No. 12001-26-2 ) and phlogopite (CAS No. 61076-94-6) are inexpensive and most common in the USA and Canada.

Calcium stearate ($Ca(C_{18}H_{35}O_2)_2$, CAS NO. 1592-23-0) may be mixed with the mica-group mineral after the mica is wet-ground (after the milling and screening) . The two materials are mixed in a process using gentle heat, which causes the calcium stearate to coat the mica. Like mica, calcium stearate is a good, dry lubricant. It has the added benefit of reducing static electricity from the printing, copying or facsimile machine operation when- used with mica as a lubricant. This is especially important in xerography because static electricity on and around the photoreceptor can cause streaks in the final product.

The optimum amount of the calcium stearate in a mica-calcium stearate lubricant mixture or compound has been found to be about one percent by weight. Unlimited amounts could be used, but calcium stearate is more expensive than mica. Much beyond ten percent by weight would not be practical, and would not significantly increase the performance of the lubricant. Mica-group minerals coated with calcium stearate have been shown to have excellent lubrication properties and are commonly used in the southern part of the USA in machines that make textiles.

The dry toner for electrophotography of this invention comprises a binder resin, a coloring agent, and a mica-group mineral with or without calcium stearate added. The function of the binder resin is to form the print or copy information onto the photoreceptor drum of the toner cartridge and ultimately to form the image on the output paper of the printer, copier or facsimile machine. It may typically contain iron oxides, magnetic iron oxides, mostly polystyrene. The coloring agent colors the copy or print information and may comprise pigments or dyestuffs. Conventional binder resins and coloring agents may be used in the toner composition of this invention, in customary amounts and particle sizes. The mica-group mineral lubricant, or the mica-group mineral coated with calcium stearate lubricant, may be mixed into the toner composition at 0.1 to around 15 percent by weight of the combined binder resin and coloring agent, and has made a quality print up to 20 percent.

Mixtures of the lubricant (which comprised 90 percent by weight or more of the mica-group mineral coated with 10 percent by weight or less of calcium stearate) with the binder resin and coloring agent were tested by applicant in amounts of lubricant ranging from 0.1 percent to 20 percent by weight of the combined binder resin and coloring agent. At 15 percent by weight mica-calcium stearate treated toner, the print quality was fine and the lubricating and flow properties of the toner seemed optimum. However, at 20 percent, shades of gray appeared around the edges of solid black areas on the image but printed fine on straight text. Down around 0.1 percent by weight of lubricant, some -effectiveness in lubrication and improved toner flow could still be seen.

The lubricant is mixed with the binder resin and coloring agent by using a blender, vibratory shaker, or other conventional mixing devices. Shaking or stirring the ingredients together by hand also appears to work sufficiently, though dry toner mixing in large amounts would require labor-saving devices. For an enduser, cartridge remanufacturer, or copy technician, simply using the lubricant as a post-additive to conventional dry toner, however, no expensive mixing device would be needed. In this embodiment, it can be packaged as a toner additive that may be used to "soup up" your toner or may be added when there is a specific problem where the toner needs better flow. One such example is when shipping seals cause blockage. Another example is poor toner sticking to fuser rollers. Another example is poor copy quality, poor toner flow, or the need of an existing toner to have better lubrication properties. In this embodiment as a post additive toner enhancer, it would be similar to someone putting STP additive in their motor oil. Motor manufacturers could just as easily put the ingredients of STP in oil. Similarly, the lubricant flow agent ingredients of this invention, primarily mica with or without calcium stearate mixed in can be used either way as a "do it yourself" post additive to existing toner, or the toner manufacturer may just add it in the toner in the first place for the superior qualities of this composition as an enhancer. It should be noted that other conventional toner ingredients, such as charge control agents and other flow and lubricating agents, may also be added to the dry toner composition of this invention. The amount of mica-group mineral lubricant (or mica-group mineral coated with calcium stearate lubricant) could be reduced in proportion to the amounts of other agents added to the toner composition. In other words, the mica and calcium stearate mixture enhance toner in any case, even if other flow agents and lubricants are already present.

When used in the toner cartridge, the dry toner composition of this invention lubricates the wiper blade as it wipes the photoreceptor drum, keeping the wiping action smooth and even and eliminating double imaging on the output paper of the printer, copier or facsimile machine. The wiper blade efficiently removes the latent electrostatic image from the drum. The added lubricant allows the dry toner to flow without clogging the constriction formed by aftermarket seals between the toner hopper and feed roller. This improved flow capability also prevents the dry toner from lumping on the developer roller, providing an even distribution along the developer roller surface. Double imaging or ghosting caused at the fuser roller section is eliminated because the lubricated toner does not stick to the heat fuser roller. This non-stick feature also makes the fuser roller, as well as the wiper blade and other components of the toner cartridge, easier to keep clean.

The fuser roller in the printer, copier or facsimile machine heats the toner and bonds or fuses it to the output paper. Older toner compositions have higher melting points so it takes the fuser roller longer to fuse the toner to the paper. Therefore, the fuser roller can't rotate as fast and can't print a large number of pages per minute. Newer toner compositions have lower melting points for high speed printing, but need to be better lubricated for quicker movement through the toner cartridge without clogging passages and fouling components. This is where the true benefits of this invention come into play. The lubricant of this invention, when used in the toner formulation or as a post-additive to the toner, enables the toner to function effectively at low melting temperature and high speed operation of the imaging machine. The resolution and sharpness of the image produced remains exceptional even after continued use of the machine at high speed.

The mica-group mineral lubricant, with or without the calcium stearate, is generally less expensive than prior art lubricants and flow agents and, according to applicant's tests, works better. Its function as a flow agent allows dry toner to be made in smaller particle size (1–5 microns) for greater image resolution and sharpness. Even though the mica-group mineral coated with calcium stearate is larger in particle size than the dry toner, it works well as both a lubricant and flow agent. A mica-group mineral alone with a particle size of 12 microns performs even better as a lubricant and flow agent, but loses some lubricity without the calcium stearate.

The mica group minerals with or without the calcium stearate will not only act as a good lubricant, flow agent and anti-stick agent to fuser rollers, not only for mono-component toners (toner and developer combined as one mixture) but may also be added in multicomponent formulations of dry toner by itself as well as dry developer powder by itself.

Since minor changes and modifications varied to fit particular operating requirements and environments will be understood by those skilled in the art, the invention is not considered limited to the specific examples chosen for purposes of illustration. The invention includes all changes and modifications which do not constitute a departure from the true spirit and scope of this invention as claimed in the following claims and as represented by reasonable equivalents to the claimed elements.

What is claimed is:

1. A dry toner for electrophotography comprising a binder resin, a coloring agent, a mica-group mineral and calcium stearate, said mica-group mineral being coated with said calcium stearate to form a composition of ninety percent by weight or more of said mica-group mineral and ten percent by weight or less of said calcium stearate.

2. A dry toner as in claim 1 wherein said composition makes up zero-point-one to about fifteen percent by weight of said dry toner.

3. A dry toner as in claim 2 wherein said mica-group mineral has been wet-ground.

4. A dry toner as in claim 1 wherein said mica-group mineral has been wet-ground.

5. A dry toner as in claim 1 wherein said binder resin and said coloring agent have a particle size of one to five microns.

6. A dry toner as in claim 5 wherein said mica-group mineral has a particle size of about twelve microns.

* * * * *